US009669990B2

(12) United States Patent
Nahm

(10) Patent No.: US 9,669,990 B2
(45) Date of Patent: Jun. 6, 2017

(54) SLEEVE FOR A CABLE SPOOL

(71) Applicant: FORETREK SYSTEMS PTY LTD, Pymble (AU)

(72) Inventor: Chang Yoon Nahm, Pymble (AU)

(73) Assignee: FORETREK SYSTEMS PTY LTD, Pymble (AU)

( * ) Notice: Subject to any disclaimer, the term of this patent is extended or adjusted under 35 U.S.C. 154(b) by 100 days.

(21) Appl. No.: 14/367,669

(22) PCT Filed: Dec. 21, 2012

(86) PCT No.: PCT/AU2012/001581
§ 371 (c)(1),
(2) Date: Jun. 20, 2014

(87) PCT Pub. No.: WO2013/091013
PCT Pub. Date: Jun. 27, 2013

(65) Prior Publication Data
US 2015/0274405 A1 Oct. 1, 2015

(30) Foreign Application Priority Data
Dec. 22, 2011 (AU) ..... 2011905375

(51) Int. Cl.
*B65H 75/24* (2006.01)
*B65D 85/04* (2006.01)
(Continued)

(52) U.S. Cl.
CPC ..... *B65D 85/04* (2013.01); *B65D 25/10* (2013.01); *B65H 75/146* (2013.01); *B65H 75/24* (2013.01);
(Continued)

(58) Field of Classification Search
CPC ..... B65H 75/24; B65H 75/146; B65H 2301/41369
See application file for complete search history.

(56) References Cited

U.S. PATENT DOCUMENTS 1,822,474 A * 9/1931 Bureau ..... B65H 75/14 242/608.4
2,355,477 A 8/1944 Stahl
(Continued)

FOREIGN PATENT DOCUMENTS

GB 1597110 A 9/1981
JP S57-3774 U 1/1982
(Continued)

OTHER PUBLICATIONS

International Search Report dated Mar. 21, 2013, for PCT/AU2012/001581.
(Continued)

*Primary Examiner* — Sang Kim
(74) *Attorney, Agent, or Firm* — Kinney & Lange, P.A.

(57) ABSTRACT

A sleeve for a cable spool having a cylindrical drum 8 and a pair of opposing end flanges. The sleeve includes a plurality of sleeve portions 7. Each sleeve portion 7 includes a body portion 10 for supporting cable thereon. The sleeve portions 7 are positionable on the cable spool such that the body portions 10 collectively define a cable support surface around the cylindrical drum 8, the cable support surface having a diameter greater than the cylindrical drum 8.

20 Claims, 7 Drawing Sheets

(51) Int. Cl.
*B65H 75/14* (2006.01)
*B65H 75/44* (2006.01)
*B65D 25/10* (2006.01)

(52) U.S. Cl.
CPC ..... *B65H 75/241* (2013.01); *B65H 75/4497* (2013.01); *B65H 2701/34* (2013.01)

(56) References Cited

U.S. PATENT DOCUMENTS

| | | | | |
|---|---|---|---|---|
| 2,905,408 | A | 9/1959 | Frate et al. | |
| 3,680,809 | A | 8/1972 | Blackmer et al. | |
| 5,556,055 | A | 9/1996 | Lindstrand | |
| 5,954,294 | A * | 9/1999 | Forsner | B65H 54/58 242/601 |
| 7,281,679 | B1 * | 10/2007 | Jones | B65H 75/18 242/609 |

FOREIGN PATENT DOCUMENTS

| | | | |
|---|---|---|---|
| JP | S57-191759 | U | 12/1982 |
| JP | H07-53137 | A | 2/1995 |
| WO | 0144088 | A2 | 6/2001 |

OTHER PUBLICATIONS

Supplementary European Search Report dated Jul. 3, 2015, received for corresponding European Application No. 12860112.

* cited by examiner

SLEEVE FOR A CABLE SPOOL

FIELD OF THE INVENTION

The present invention relates to spools for storing cable, wire and the like. More particularly, the present invention relates to a sleeve for a spool.

BACKGROUND OF THE INVENTION

Spools are commonly used to store cable, for example electrical cable. Spools typically include a cylindrical drum with an end flange being provided at each end the drum. Cable is wound about the cylindrical drum in multiple layers.

The dimensions of a spool are largely dependent upon the size and type of cable the spool is designed to carry. With increasing cable diameter the ability of cable to bend generally decreases. As a result, a spool with a cylindrical drum of larger diameter is required. In this respect, the diameter of the cylindrical drum must be large enough to enable the cable to conform with the curvature of the drum. If the diameter of the drum is too small, the cable risks being bent beyond its limits. Accordingly, if cables of different diameters are stored on the same spool, the diameter of the cylindrical drum must be suitable to accommodate the cable having the largest diameter.

A problem with storing cables of differing diameter on the same spool, for example two different diameter cables, is that the smaller diameter cable covering one half of the drum can get snagged on the larger diameter cable covering the other half of the drum, when the smaller diameter cable is being unwound from the spool. In order to address this problem, attempts have been made in the past to provide some form of divider at the mid-point of the drum. While divided spools are of assistance, they are not able to be readily retro-fitted to existing spools.

It would be desirable to provide a device which overcomes or ameliorates at least one of the above mentioned problems with the existing art.

Any discussion of documents, devices, acts or knowledge in this specification is included to explain the context of the invention. It should not be taken as an admission that any of the material formed part of the prior art base or the common general knowledge in the relevant art in Australia or any other country.

SUMMARY OF THE INVENTION

In accordance with a first aspect of the present invention, there is provided sleeve for a cable spool having a cylindrical drum and a pair of opposing end flanges, the sleeve including a plurality of sleeve portions, each sleeve portion including a body portion for supporting cable thereon, wherein the sleeve portions are positionable on the cable spool such that the body portions collectively define a cable support surface around the cylindrical drum, the cable support surface having a diameter greater than the cylindrical drum.

In a first embodiment of the invention, the sleeve portion further includes a pair of upstanding members, the body portion bridging the upstanding members together. In this respect, each upstanding member may include a base for positioning on the cylindrical drum and a wall section extending away from the base, opposite ends of the body portion can be connected to opposing wall sections to bridge the upstanding members.

The ends of the body portion can preferably be mounted in one or more spaced openings provided in the wall sections such that the distance between the body portion and respective bases of the upstanding members can be adjusted to thereby change the diameter of the cable support surface.

Adjacent sleeve portions may be connectable together by interlocking means provided on the base of the upstanding members.

The upstanding members of one sleeve portion may substantially align with the upstanding members of an adjacent sleeve portion when the sleeve portions are positioned on the cylindrical drum.

In another embodiment of the invention, at least one of the sleeve portions further includes one or more flange members extending radially from the body portion, the one or more flange members dividing the cable support surface into sections.

Further, the sleeve may include a pair of sleeve portions with one or more of the flange members being provided on both sleeve portions. In addition, a flange member of one sleeve portion may be substantially aligned with a flange member of the other sleeve portion such that, when the sleeve portions are positioned on the cable spool, the aligned flange members together define a divider between the sections of the cable support surface. The aligned flange members may also be sized such that the divider extends substantially around the circumference cable support surface.

The aligned flange members may divide the cable support surface into at least a first section and a second section, the body portion of each sleeve portion being sized such that an outer radius of the first section is different to an outer radius of the second section.

Alternatively, the aligned flange members may divide the tubular hub into at least first, second and third sections, the body portion of each sleeve portion being sized such that an outer radius of each section is different to one another.

At least one of the sleeve portions may further include an upstanding member at each end of the body portion. More preferably, each sleeve portion includes an upstanding member at each end of the body portion. Adjacent upstanding members may abut one another to form a substantially continuous wall at the ends of the body portions.

The sleeve may further include one or more fastening members for securing adjacent upstanding members in abutment with one another. In this respect, the fastening members can be securable in aligned grooves provided in adjacent upstanding members.

Further, the body portions may be sized such that the cable support surface formed around the cylindrical drum is substantially continuous.

One or more of the body portions can also be integrally formed with at least one flange member.

In another embodiment, the aligned flange members may be moveable along the body portions to thereby adjust the size of the cable support surface sections. Further, one or more of the body portions may include guide means for guiding movement of the aligned flange members along the body portions.

The body portions may also be arcuate in shape to substantially match the curvature of the cylindrical drum.

In accordance with another aspect of the present invention, there is provided a sleeve for a cable spool having a cylindrical drum and a pair of opposing end flanges. The sleeve includes a plurality of sleeve portions, each sleeve portion includes an arcuate body portion. At least one of the sleeve portions further includes one or more flange members extending radially from the body portion, wherein the sleeve portions are positionable on the cable spool such that the arcuate body portions together define a cable support surface around the cylindrical drum with the one or more flange members dividing the cable support surface into sections.

The present invention is advantageously able to convert a conventional cable spool, having a cylindrical drum of constant diameter, to a cable spool divided into sections. Further, the present invention enables a conventional cable spool to be customised to the desired requirements of a particular cable. In addition, the ability of the flange members to move relative to the arcuate body portions advantageously enables the cable spool to be divided into sections of a desired size.

BRIEF DESCRIPTION OF THE DRAWINGS

Further benefits and advantages of the present invention will become apparent from the following description of preferred embodiments of the invention. The following description should not be considered as limiting any of the statements in the previous section. Preferred embodiments will be described with reference to the following figures in which.

DESCRIPTION OF THE PREFERRED EMBODIMENTS

With reference to the accompanying drawings there is shown various embodiments of a sleeve 1 for a cable spool 3. The cable spool 3 has a cylindrical drum and a pair of opposing end flanges 5. The sleeve 1 including a plurality of sleeve portions 7.

Figure 1:
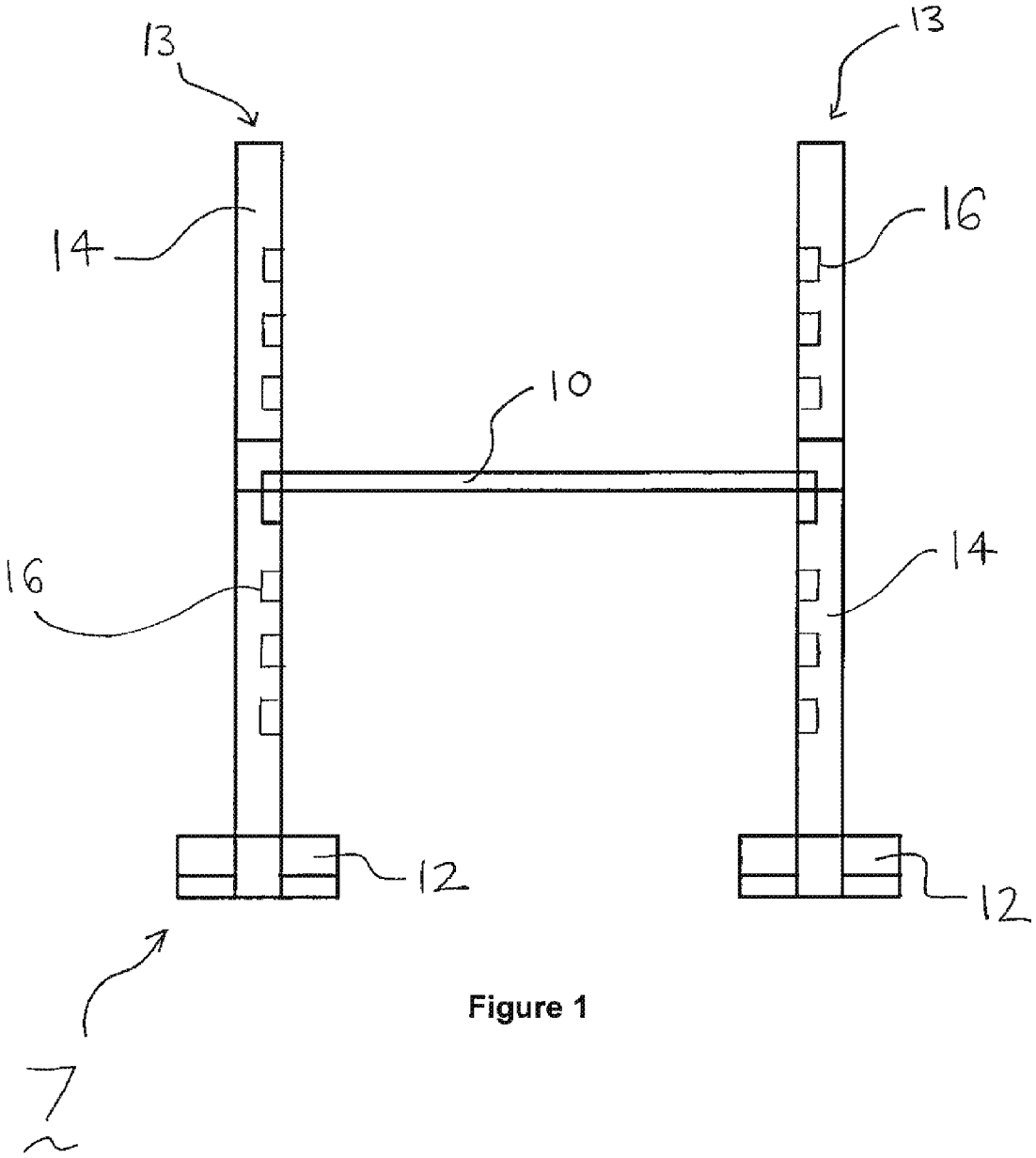
FIG. 1 is a side view of one sleeve portion of a sleeve in accordance with a first embodiment of the invention.
Figure 1A:
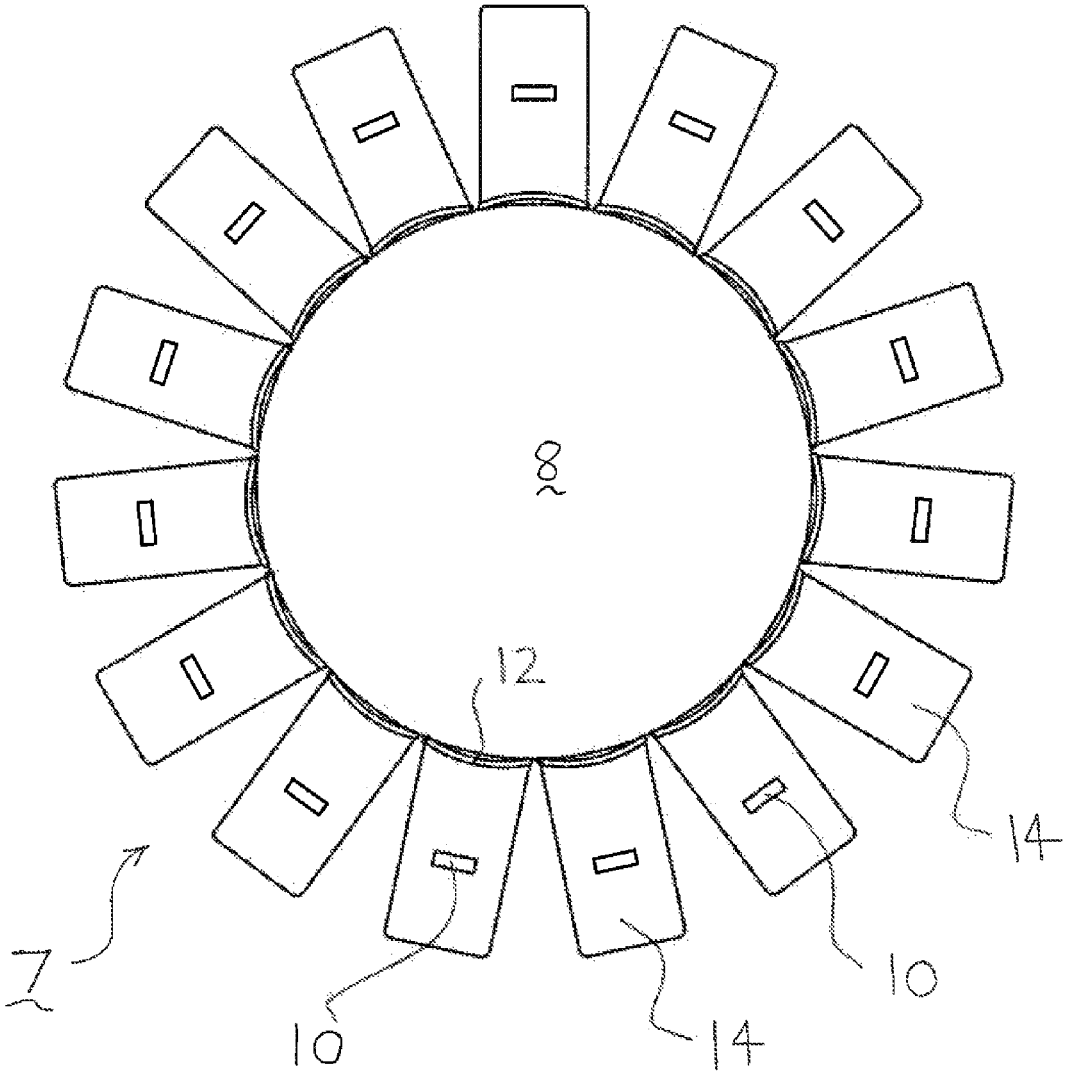
FIG. 1*a* is an end view of a plurality of sleeve portions shown in FIG. 1 attached around a cylindrical drum of a cable spool.
Figure 1B:
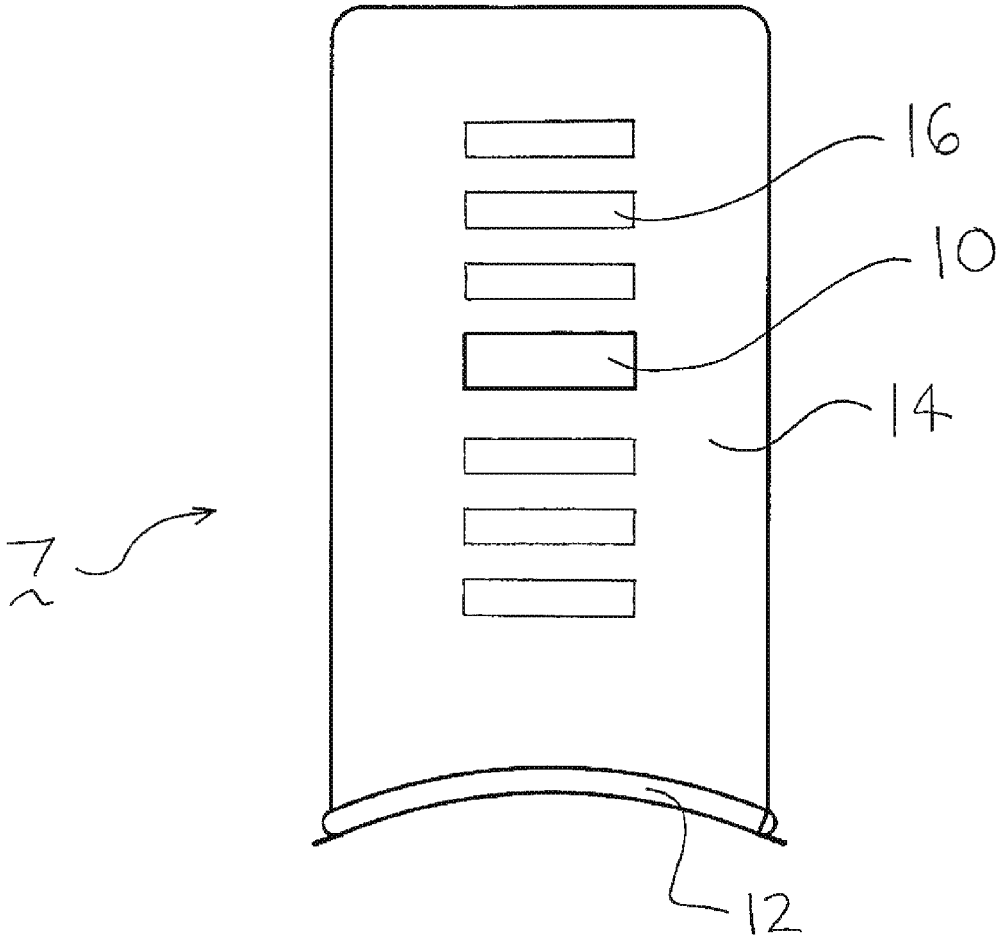
FIG. 1*b* is an end view of the sleeve portion shown in FIG. 1.
Figure 1C:
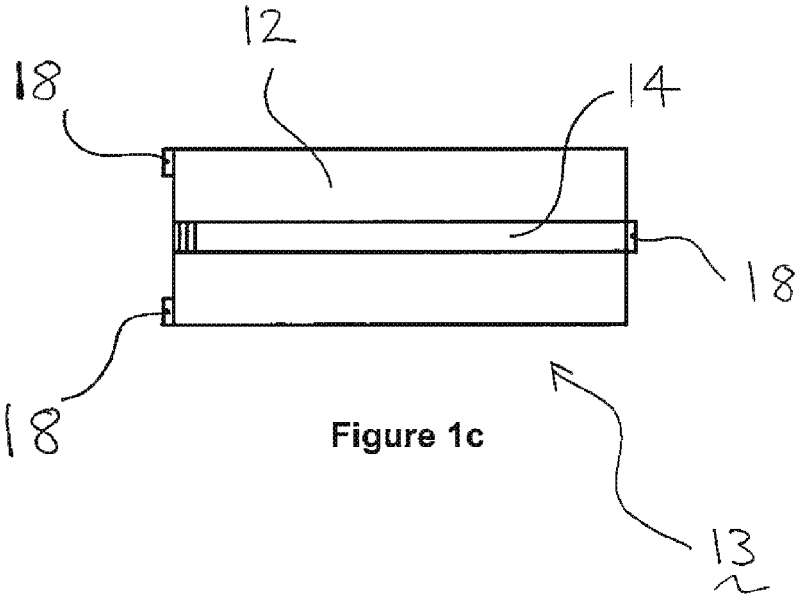
FIG. 1*c* is a top view of an upstanding member of the sleeve portion shown in FIG. 1.

In a first embodiment shown in FIGS. 1 to 1C, the sleeve 1 is made up of a multiple number individual sleeve portions 7 which are substantially identical. In FIG. 1A the sleeve portions are shown mounted to a cylindrical drum 8 of a cable spool. The sleeve portions 7 each include a body portion for supporting cable thereon. In the embodiment shown in FIGS. 1 to 10, the body portion is preferably in the form of an elongate cross member 10. The sleeve portion 7 also includes an upstanding member 13 at both ends of the cross member 10. The upstanding members 13 oppose one another and each include a base 12 and a wall section 14 extending away from the base 12. The wall section 14 includes a plurality of spaced openings 16 into which the end of the cross member 10 can be located to thereby adjust the position of the cross member 10. By engaging the cross member 10 in openings 16 which are further away from the base 12 of the upstanding members 13, the radius of the cable support surface collectively formed by the cross members 10 of the sleeve portions can be increased. Likewise, the cross member 10 can be located in openings 16 closer to the base 12 of the upstanding members 13 when a cable support surface having a diameter closer to the diameter of the cylindrical drum 8 is required. As shown in FIG. 1B, the base 12 of the upstanding member 13 can be curved to match the curvature of the cylindrical drum 8 of the cable spool to which the sleeve portion 7 is to be applied. The base 12 may also include some form of fastening means such as locking tabs 18 to enable the base 12 of adjacent sleeve portions 7 to be interconnected. The overall width of the sleeve portion 7 shown in FIG. 1 is largely dependent upon the length chosen for the cross member 10. If the sleeve 1 is to occupy for example only half of the longitudinal length of the cylindrical drum 8, an appropriate length for the cross members 10 would be chosen for this to occur.

When attaching the sleeve 1 to the cable spool 3, the sleeve 1 is preferably mounted towards one end of the cable spool 3 with one upstanding member 13 of each sleeve portion 7 in close proximity or abutment with an end flange 5 of the cable spool 3. The upstanding members 13 are positioned on the cable spool 3 one behind the other as shown in FIG. 1A. Two rows of upstanding members 13 are created with the first row being made up of the upstanding members 13 at one end of sleeve portions 7 and the second row being made up of the upstanding members 13 from the other end of the sleeve portions 7. Further rows of upstanding member 13 can be provided around the cylindrical drum 8 and additional cross members 10 utilised to create one or more additional cable support surfaces of a chosen diameter.

Once the first upstanding member 13 of each row has been fastened to the cylindrical drum 8, for example by inserting a fastener through the base 12 and into the drum 8, the base 12 of the next upstanding member 13 in the row can either be interconnected to the base of the first upstanding member 13 via locking tabs 18, or alternatively fastened directly to the cylindrical drum 8 in the same manner as the first upstanding member 13. Similarly, further upstanding members 13 in the row can either be interconnected to neighbouring upstanding members 13 via the locking tabs 18 or be individually fastened directly to the cylindrical drum 8 in the same manner as the first upstanding member 13. Although fifteen sleeve portions are mounted to the cylindrical drum 8 in FIG. 1A, the number of sleeve portions required to extend around the entire circumference of the cylindrical drum 8 will vary depending upon the diameter of the cylindrical drum 8.

With the sleeve in accordance with the first embodiment in position on the cylindrical drum 8, the upstanding members 13 forming the second row prevent cable wound around the cable support surface (created by the connecting members 10) from interfering with another cable that may be wound around the cylindrical drum 8 next to the sleeve.

In the embodiments shown in FIGS. 2 to 7B of the drawings, the sleeve 1 includes two sleeve portions 7 which are substantially identical. Each sleeve portion 7 includes an arcuate body portion 9 and at least one flange member 11 extending radially from the body portion 9. The arcuate body portions 9 collectively define a cable support surface in the form a tubular hub which can be positioned around the cylindrical drum of a cable spool 3. In the embodiments shown in FIGS. 2 to 7B of the drawings, each arcuate body portion 9 represents one half of the tubular hub. However, in other embodiments, each arcuate body portion 9 could be sized to represent a third, a quarter, a fifth, etc of the tubular hub.

Figure 2:
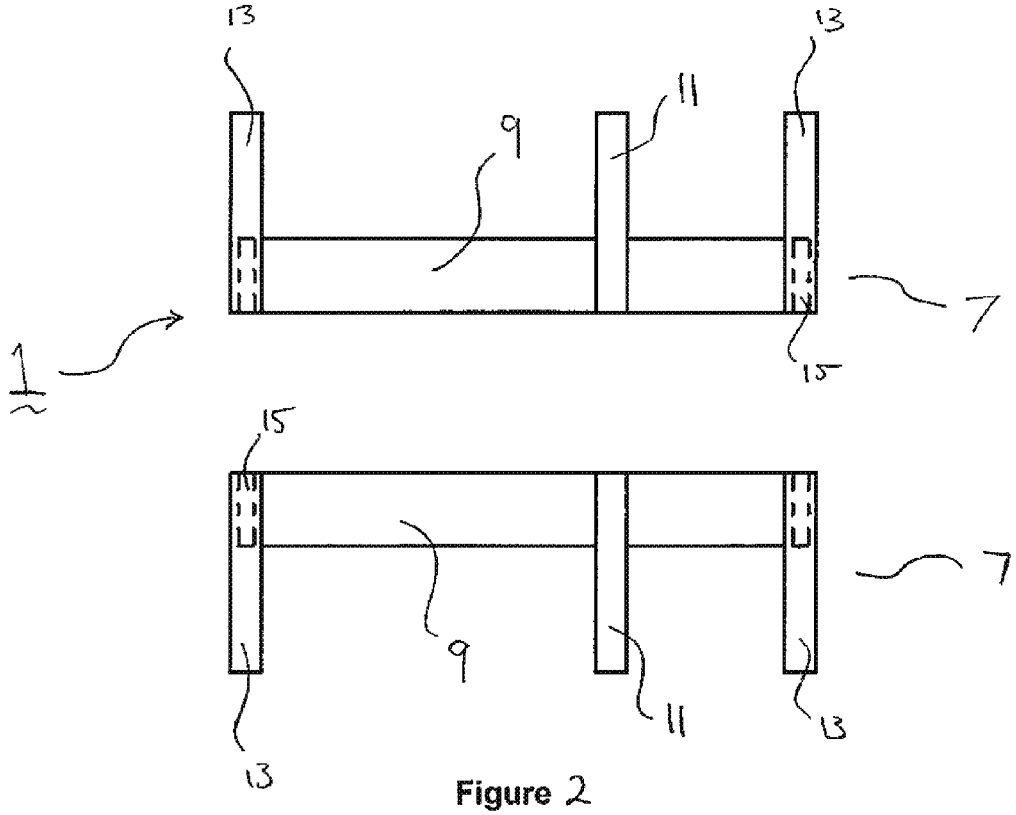
FIG. 2 is a side view of a sleeve including a pair of sleeve portions with both portions having a flange member and upstanding members, in accordance with a second embodiment of the invention.

In the embodiment shown in FIG. 2, the sleeve 1 includes a pair of sleeve portions 7 with each portion 7 having a body portion 9 of substantially uniform thickness which is curved like the outer surface of a half-cylinder. When the sleeve portions 7 are paired together, the body portions 9 abut one another to provide a tubular hub having a substantially continuous cylindrical surface. Both sleeve portions 7 further include a flange member 11 which projects radially from the body portion 9. The flange member 11 is substantially planar and has an outer edge which lies parallel to the curvature of the body portion 9. When the sleeve portions 7 are placed together, the flange members 11 of the sleeve portions 7 abut one another to provide a ring-like surface around the circumference of the tubular hub. The aligned flange members 11 forming the ring-like surface divide the tubular hub into discrete sections.

Figure 2A:
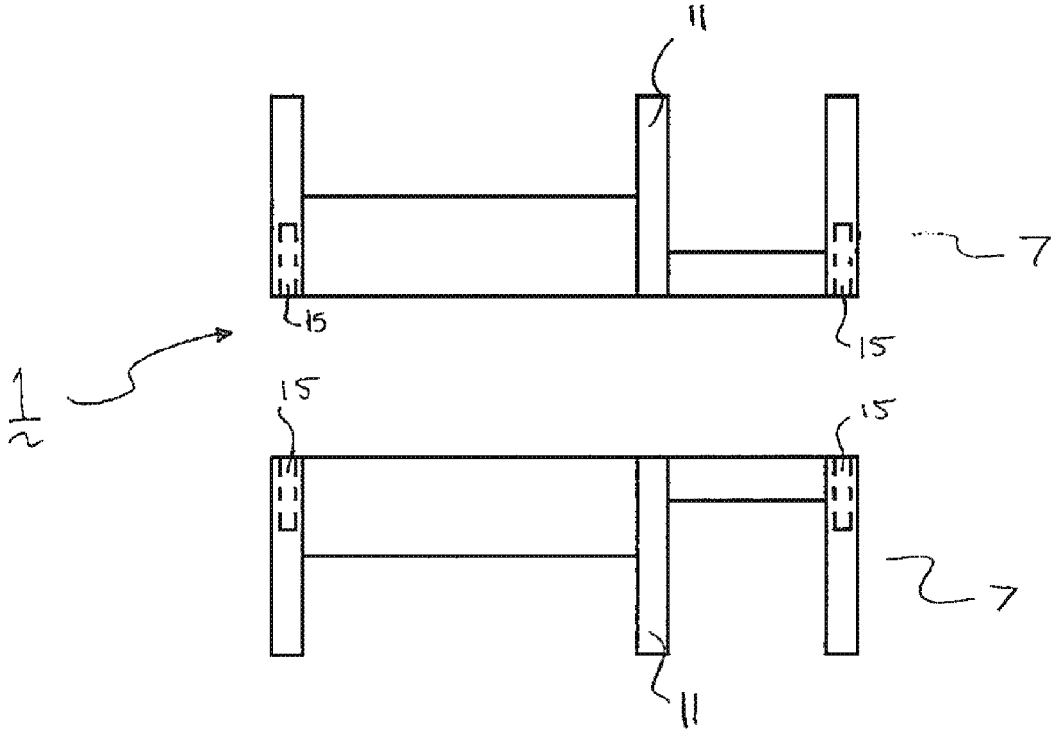
FIG. 2*a* is a side view of a sleeve having sleeve portions similar to that shown in FIG. 2, with each sleeve portion being sized such that a first section has an outer radius which is different to the outer radius of a second section, in accordance with a further embodiment of the invention.

The sleeve 1 in the embodiment shown in FIG. 2A is similar to that shown in FIG. 2. However, in FIG. 2A an outer surface of each body portion 9 has a different radius of curvature at either side of the flange member 11, and an inner surface of each body portion 9 has a radius of curvature to match the curvature of the cylindrical drum of the cable spool 3. Accordingly, when the sleeve portions 7 are placed together to form a tubular hub, one section of the tubular hub has an outer surface with a radius which is different to the remaining outer surface of the tubular hub.

While the sleeve portions 7 shown in FIG. 2A have body portions 9 with two regions of different radius of curvature, other embodiments of the sleeve 1 may include more regions having different radius of curvature.

Figure 3:
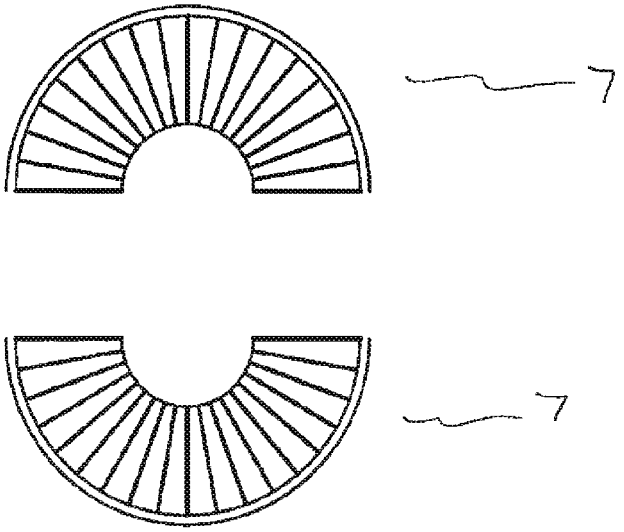
FIG. 3 is an end view of the sleeves shown in FIGS. 2 and 2*a;*

The sleeves 1 in the embodiments shown in FIGS. 2 and 2A further include an upstanding member 13 provided at each end of the body portion 9. As best shown in FIG. 3, the upstanding members 13 extend 180° in an arc formation such that when the sleeve portions 7 are connected together the upstanding members 11 abut one another to form a substantially continuous wall at the end of the body portions 9.

Figure 4:
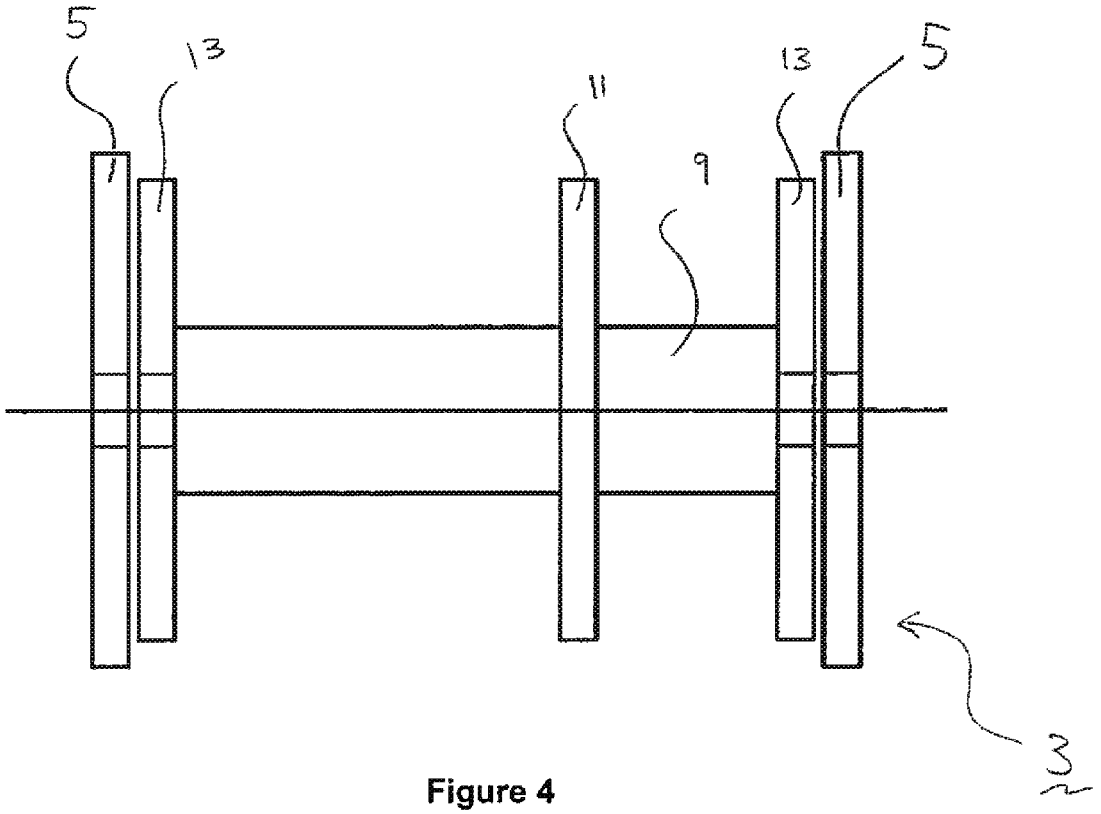
FIG. 4 is a side view of the sleeve shown in FIG. 2 attached to a conventional cable spool having a cylindrical drum and a pair of opposing end flanges.

As shown in FIG. 4, when the sleeve portions 7 are positioned on a cable spool 3, the arcuate body portions 7 together define a tubular hub around the cylindrical drum of the cable spool 3 with the flange members 11 dividing the tubular hub into sections. In FIG. 4, the flange member 11 of each opposing sleeve portion 7 is aligned with the aligned flange members 11 dividing the tubular hub into a first section and a second section. Accordingly, cable wound around the first section is separated from cable wound around the second section. As a result, the cables are prevented from interfering with each other on the hub.

In order to secure the upstanding wall members 13 together, a series of grooves 15 may be provided in each wall member 13 with the grooves 15 of adjacent sleeve portions 7 being aligned to form an internal cavity into which a fastening member, preferably in the form of a planar end cap, may be inserted to secure the sleeve portions 7 together.

One or more roller guides, not illustrated in FIG. 4, may be positioned between the cylindrical drum of the cable spool 3 and the sleeve 1 such that the sleeve 1 is able to rotate relative to the cable spool 3. This enables cable on sleeve 1 to be unwound from the cable spool 3 while the cable spool 3 is stationary, for example resting on the ground.

Figure 5:
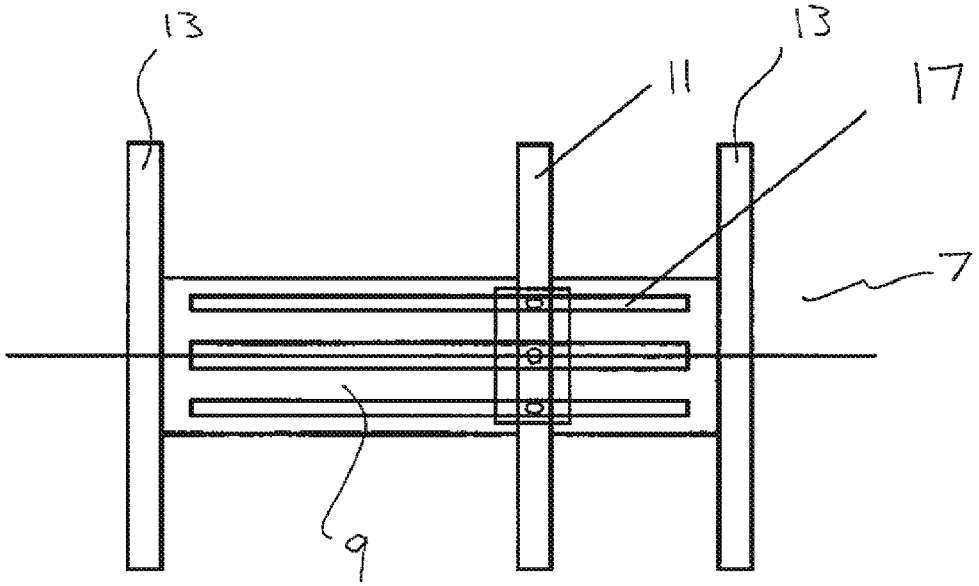
FIG. 5 is a side view of a sleeve portion having a movable flange member, in accordance with a further embodiment of the invention.
Figure 6:
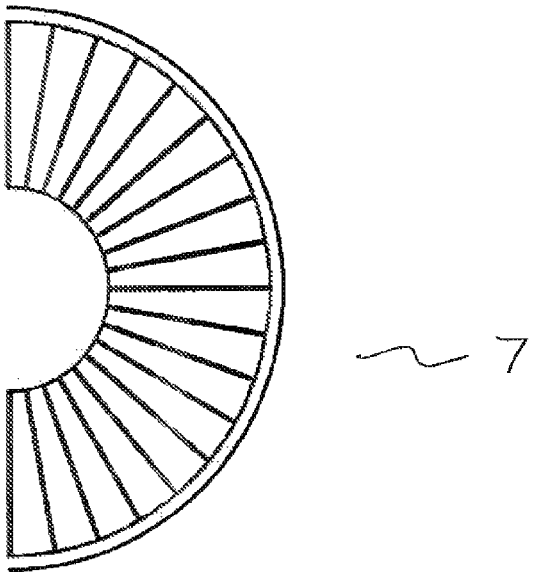
FIG. 6 is an end view of the sleeve portion shown in FIG. 5.

With reference to FIG. 5, there is shown a sleeve portion 7 in accordance with a further embodiment of the invention. In this particular embodiment, the flange member 11 is movable along the body portion 9 to thereby adjust the positioning of the flange member 11. Accordingly, the width of the sections created when the sleeve portions 7 are joined together can be altered. In order to facilitate movement of the flange member 11, the body portion 9 of the sleeve portion 7 is provided with guide means for guiding movement of the flange member 11 along the body portion 9. The guide means is preferably in the form of an elongate track 17. The flange member 11 is provided with a corresponding member which engages with the elongate track 17 such that movement of the flange member 11 is restricted to longitudinal movement along the body portion 9. As shown in FIG. 6, the sleeve portion 7 in this particular embodiment also includes an upstanding member 13 at each end which is preferably in a 180° arc similar to the sleeve portions 7 shown in FIGS. 1 and 2. In other embodiments, the shape of the upstanding members 13 could include a flat edge such that the upstanding members 13 can rest on the ground without the sleeve portions 7 rolling away.

Whilst the sleeve 1 is intended to be applied to a conventional cable spool 3, the sleeve 1 may be used in a stand alone form in a similar manner to a conventional cable spool with dividers.

Figure 7A:
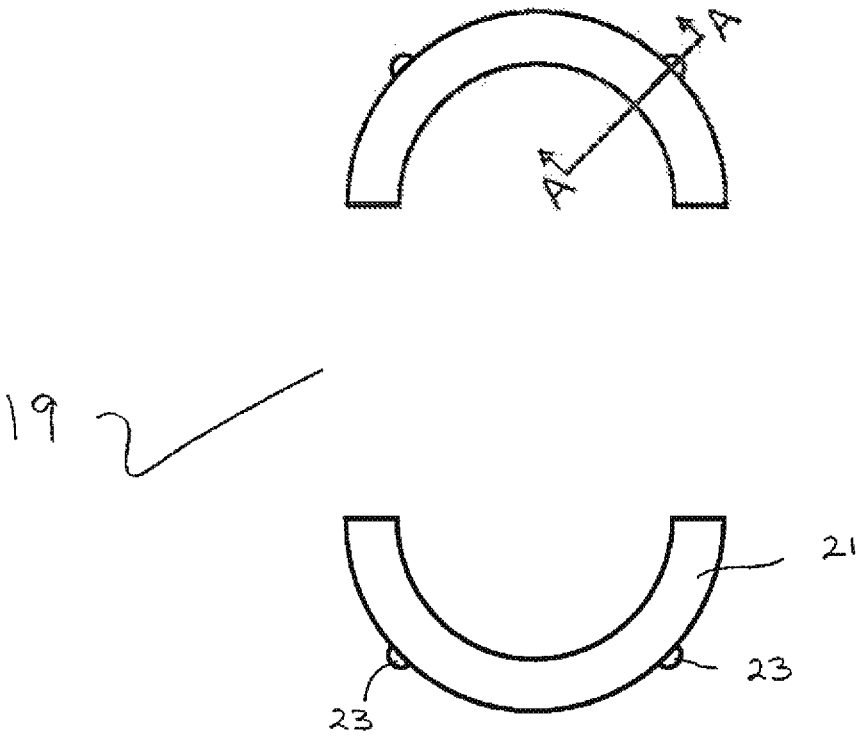
FIG. 7A is a side view of two halves of a roller guide for mounting between a conventional cable spool and a sleeve, in accordance with a further embodiment of the invention.
Figure 7B:
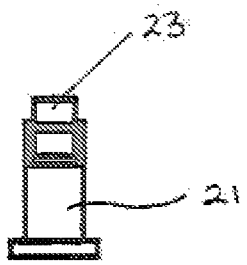
FIG. 7B is a cross sectional view of one of the roller guide halves illustrated in FIG. 7A

In a further embodiment of the invention, the cylindrical drum of the cable spool 3 may include one or more roller guides 19 securely mounted thereon. With reference to FIGS. 7A and 7B, the roller guide 19 includes two halves which each include a main body 21 and one or more rollers 23 mounted on the main body 21 at a distal end. A roller guide 19 is preferably mounted at both ends of the cylindrical drum with the distance between the roller guides 19 corresponding to the distance between the grooves 15 in the opposing wall members 13 of the sleeve 1. As a result, the roller guides 19 can be seated in the grooves 15 such the rollers 23 abut with an end of the grooves 15. This enables the sleeve 1 to rotate on the rollers 23 while the cable spool 3 and main body 21 of the roller guide 19 remains stationary. Cable provided on the sleeve 1 can thereby be wind up or unwound with the cable spool 3 stationary. The cable spool 3 is therefore advantageously not needed to be mounted on a stand or caddy.

In a further embodiment, cog teeth may also be provided on the inner surface of the body portion 9 of each sleeve portion 7 to mechanically assist in winding cable provided on the sleeve 1. In this respect at least one of the upstanding members 13 includes an aperture therein to allow for the installation of a matching gear set. The matching gear set can be connected to an electric motor or crank.

The sleeve in accordance with the present invention advantageously enables multiple cables to be stored on the same cable spool without interference. Further, by having regions of different diameter, the sleeve enables a conventional cable spool to accommodate cable with different diameters and lengths and different bending radii, thus minimising the number of spools which need to be handled.

As the present invention may be embodied in separate forms without departing from the essential characteristics of the invention, it should be understood that the above described embodiment should not be considered to limit the present invention but rather should be construed broadly. Various modifications and equivalent arrangements are intended to be within the spirit and scope of the invention.

The invention claimed is:

1. A sleeve for a cable spool having a cylindrical drum and a pair of opposing end flanges, the sleeve including a plurality of sleeve portions, each sleeve portion including a pair of upstanding members and a body portion for supporting cable thereon, the body portion bridging the upstanding members together, each upstanding member including a base for positioning on the cylindrical drum and a wall section extending away from the base, opposite ends of the body portion being connected to opposing wall sections to bridge the upstanding members, wherein the sleeve portions are positionable on the cylindrical drum of the cable spool such that the body portions collectively define a cable support surface around the cylindrical drum, the cable support surface having a diameter greater than the cylindrical drum, and wherein the ends of the body portion are mountable in one or more spaced openings provided in the wall sections such that a distance between the body portion and respective bases of the upstanding members can be adjusted to thereby change the diameter of the cable support surface.

2. The sleeve as claimed in claim 1 wherein adjacent sleeve portions are connectable together by interlocking means provided on the base of the upstanding members.

3. The sleeve as claimed in claim 2 wherein the upstanding members are positionable one behind the other on the cable spool to create two rows of upstanding members around a circumference of the cylindrical drum.

4. The sleeve as claimed in claim 2 wherein a first row of the upstanding members is provided by upstanding members at one end of the sleeve portions and a second row of the upstanding members is provided by upstanding members at the other end of the sleeve portions.

5. The sleeve as claimed in claim 4 wherein a first upstanding member of each row is fastenable to the cylindrical drum and the next upstanding member of each row is interconnected to the base of the first upstanding member by the interlocking means.

6. The sleeve as claimed in claim 1 wherein the upstanding members of one sleeve portion substantially align with the upstanding members of an adjacent sleeve portion when the sleeve portions are positioned on the cylindrical drum.

7. The sleeve as claimed in claim 6 including further rows of upstanding members around the cylindrical drum and additional cross members to create one or more additional cable support surfaces of a chosen diameter.

8. The sleeve as claimed in claim 1 wherein at least one of the sleeve portions further includes one or more flange members extending radially from the body portion, the one or more flange members dividing the cable support surface into sections.

9. The sleeve as claimed in claim 8 wherein the sleeve includes a pair of sleeve portions with one or more flange members being provided on both sleeve portions.

10. The sleeve as claimed in claim 9 wherein a flange member of one sleeve portion is substantially aligned with a flange member of the other sleeve portion such that, when the sleeve portions are positioned on the cable spool, the aligned flange members together define a divider between the sections of the cable support surface.

11. The sleeve as claimed in claim 10 wherein the aligned flange members are sized such that the divider extends substantially around the circumference cable support surface.

12. The sleeve as claimed in claim 10 wherein the aligned flange members divide the cable support surface into at least a first section and a second section, the body portion of each sleeve portion being sized such that an outer radius of the first section is different to an outer radius of the second section.

13. The sleeve as claimed in claim 12 wherein the aligned flange members are moveable along the body portions to thereby adjust the size of the cable support surface sections.

14. The sleeve as claimed in claim 13 wherein one or more of the body portions includes guide means for guiding movement of the aligned flange members along the body portions.

15. The sleeve as claimed in claim 10 wherein the aligned flange members divide the tubular hub into at least first, second and third sections, the body portion of each sleeve portion being sized such that an outer radius of each section is different to one another.

16. The sleeve as claimed in claim 8 wherein at least one of the sleeve portions further includes an upstanding member at each end of the body portion.

17. The sleeve as claimed in claim 16 wherein each sleeve portion includes an upstanding member at each end of the body portion.

18. The sleeve as claimed in claim 1 further including one or more fastening members for securing adjacent upstanding members in abutment with one another.

19. The sleeve as claimed in claim 18 wherein the fastening members are securable in aligned grooves provided in adjacent upstanding members.

20. The sleeve as claimed in claim 8 wherein the body portions as sized such that the cable support surface formed around the cylindrical drum is substantially continuous.

* * * * *